US007708067B2

(12) United States Patent
Treviranus et al.

(10) Patent No.: US 7,708,067 B2
(45) Date of Patent: May 4, 2010

(54) APPARATUS AND METHOD FOR ESTIMATING ORIENTATION OF A LINER DURING DRILLING OF A WELLBORE

(75) Inventors: Joachim Treviranus, Winsen/Aller (DE); Sven Krueger, Winsen/Aller (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/200,256

(22) Filed: Aug. 28, 2008

(65) Prior Publication Data

US 2009/0056938 A1 Mar. 5, 2009

Related U.S. Application Data

(60) Provisional application No. 60/969,029, filed on Aug. 30, 2007.

(51) Int. Cl.
*E21B 47/09* (2006.01)

(52) U.S. Cl. ..... 166/255.2; 175/45

(58) Field of Classification Search ..... 166/255.2; 175/40, 45, 171

See application file for complete search history.

(56) References Cited

U.S. PATENT DOCUMENTS

| | | | | |
|---|---|---|---|---|
| 3,059,707 | A | 10/1962 | Frisby | |
| 5,871,046 | A | 2/1999 | Robison | |
| 6,543,536 | B2 * | 4/2003 | Dewey et al. | 166/255.2 |
| 6,581,480 | B1 | 6/2003 | May et al. | |
| 2005/0193834 | A1 | 9/2005 | May | |
| 2008/0035376 | A1 | 2/2008 | Freyer | |
| 2009/0057015 | A1 * | 3/2009 | Treviranus et al. | 175/57 |

FOREIGN PATENT DOCUMENTS

| | | | |
|---|---|---|---|
| WO | 02063262 | A1 | 8/2002 |
| WO | 2005064281 | A1 | 7/2005 |
| WO | 2005064301 | A1 | 7/2005 |

* cited by examiner

*Primary Examiner*—William P Neuder
(74) *Attorney, Agent, or Firm*—Madan & Sriram, P.C.

(57) ABSTRACT

An apparatus for use in a wellbore is disclosed that in one aspect includes a drilling assembly configured for use in drilling the wellbore, a liner disposed outside a portion of the drilling assembly that includes a feature at a selected location of the liner, and a liner orientation sensor for providing signals representative of the displacement or movement of the feature relative to the drilling assembly.

20 Claims, 2 Drawing Sheets

APPARATUS AND METHOD FOR ESTIMATING ORIENTATION OF A LINER DURING DRILLING OF A WELLBORE

CROSS-REFERENCE TO RELATED APPLICATION

This application takes priority from U.S. Provisional Patent Application Ser. No. 60/969,029, filed on Aug. 30, 2007.

BACKGROUND

1. Field of the Disclosure

This disclosure relates generally to estimating orientation of a liner conveyed in a wellbore and deploying the liner based on such orientation.

2. Background of the Art

Oil wells (also referred to as "wellbores" or "boreholes") are typically drilled with a drill string having a drilling assembly (also referred to as a "bottom hole assembly" (BHA)) at the bottom end of a tubular member (such as a jointed pipe or coiled-tubing). A drill bit is attached at the end of drilling assembly to drill the wellbore. Once the wellbore has been drilled, the drill string is retrieved to the surface and a casing is set in the wellbore to avoid a collapse of the wellbore. Such a method requires removing the drill string from the wellbore before deploying and setting the casing in the wellbore.

Wellbores are sometimes drilled wherein a liner is placed outside the drill string. The drilling assembly used for such operations includes a drill bit (referred to as the "pilot" bit) to drill a small diameter hole followed by an underreamer (a larger diameter drill bit) which enlarges the pilot hole to a size greater than the outer dimensions of the liner. The drilling assembly is retrievably disposed at or below the liner bottom so that it can be retrieved without retrieving the liner. The liner is set in the wellbore after drilling the wellbore.

Many wellbores include sections of different inclinations and curvatures. Some wellbores are further developed by drilling lateral wellbores from the initial or main wellbore. In some cases, it is desirable to form features, such as windows for drilling lateral wellbores, in the liner before it is deployed in the wellbore so as to avoid secondary operations, such as cutting a window in the liner. These and other features can be formed at the surface with greater precision and at a relatively low cost compared to forming such features in the liner after the liner has been deployed in the wellbore. The orientation of the features formed at the surface relative to the drilling assembly or the drill string is known before the deployment of the liner around the drill string. However, due to the relatively long length of the liner and the rotational forces to which it is subjected in the wellbore, the relative location of these features with respect to a known location on the drilling assembly is subject to change.

The disclosure herein provides apparatus and methods for estimating orientation of a liner in the wellbore and taking one or more actions based on such estimate.

SUMMARY

Apparatus and methods for estimating orientation of a liner associated with a drilling assembly are disclosed. An apparatus made according to one embodiment may include a drilling assembly configured for use in drilling a wellbore, a liner disposed outside the drilling assembly, which liner includes a feature at a selected location of the liner, and a liner orientation sensor that provides signals representative of the movement or displacement of the feature relative to the drilling assembly.

A method for estimating an orientation of a liner in a wellbore may include: conveying the drill string in the wellbore; providing a liner outside the drill string, the liner including a feature at a selected location of the liner; using an orientation sensor to provide signals representative of a movement or displacement of the feature on the liner relative to the drill string; estimating from the signals the orientation of the feature of the liner. In another aspect, the method may include estimating an orientation of a drilling assembly at the bottom of the drill string and using the estimated orientation of the drilling assembly and the measurement made by the liner orientation sensor to estimate the orientation of the feature. The method may further include setting the liner in the wellbore at least in part based on the estimated orientation of the feature on the liner.

Examples of the more important features of the apparatus and methods for estimating orientation of a liner and the deployment of the liner based on such estimation are summarized herein rather broadly in order that the detailed description thereof that follows may be better understood, and in order that the contributions made to the art may be appreciated. There are, of course, additional features of the apparatus and methods that will be described hereinafter and which will form the subject of the claims made pursuant to this application. An abstract is provided herein to satisfy certain regulatory requirements. The summary and the abstract are not intended to limit the scope of any claim made in this application or an application that may take priority from this application.

BRIEF DESCRIPTION OF THE DRAWINGS

For detailed understanding of the disclosure, references should be made to the following detailed description, taken in conjunction with the accompanying drawings in which like elements are generally designated by like numerals, and wherein.

DETAILED DESCRIPTION

Figure 1:
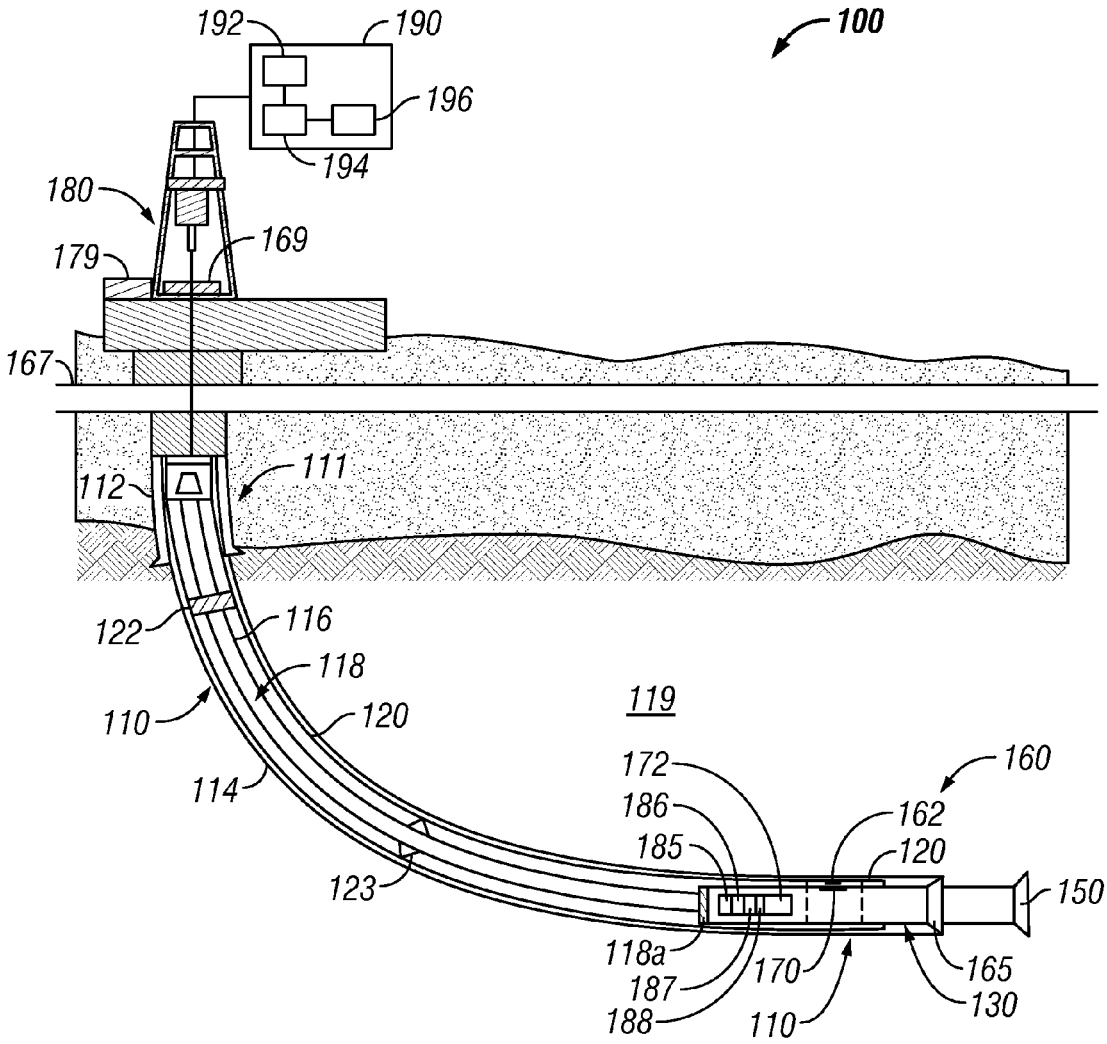
FIG. 1 is a schematic diagram of a system for drilling a wellbore, which system includes a drilling assembly, an associated liner having a feature and a sensor for providing measurements relating to the movement of the liner feature according to one embodiment of the disclosure.

FIG. 1 is a schematic diagram of a drilling system 100 that utilizes a liner disposed outside a portion of a drill string or drilling assembly for drilling a wellbore according to one embodiment of the disclosure. The drilling system 100 shows a wellbore 110 being formed in a subsurface formation 119 with a drill string 118. The wellbore 110 is shown to include an upper section 111 that has installed therein a casing 112 and a lower section 114 that is smaller in diameter than the upper section 111 and has no liner therein. The drill string 118 is shown to include a drilling assembly 130 conveyed into the wellbore from the surface 167 by a drilling tubular 116. The drilling tubular may be a drill pipe made up of jointed drilling pipe sections or a coiled-tubing. The drilling assembly 130 is attached to a bottom end of the drilling tubular 116 by a suitable connector 118*a*. A liner 120 is shown deployed outside the drill string 118 and a portion of the drilling assembly 130. The liner 120 is shown hung in the wellbore 110 via a liner hanger 122 that allows the drill string 118 to pass therethrough. The liner 120 may be detachably coupled to the drilling tubular 116 at a suitable location by a connector 123. The liner 120 in other embodiments may extend from a location at or below the surface to a location above the drilling assembly 130.

The drill string 118 extends to a rig 180 at the surface 167. The rig shown herein is a land rig for explanation purposes only. The apparatus and methods disclosed herein may be utilized with an offshore rig or structures used for drilling wellbores under water. A rotary table 169 or a top drive (not shown) may be utilized to rotate the drilling tubular 116, the drilling assembly 130 and the liner 120. A reamer unit 160 that includes a reaming drill bit 165 may be deployed at or below the bottom end 121 of the liner 120. The reamer unit 160 may be detachably attached to the drill string 118 at a suitable location on the drilling assembly 130 above or uphole of the pilot bit 150. The liner 120 may be of fixed outside dimensions (a non-expandable liner) or it may be a relatively flexible liner that can be expanded while the liner is in the wellbore (an expandable liner). When an expandable liner is used, it may be expanded when the reaming drill bit 165 is pulled out of the wellbore or by another suitable expanding device deployed at or below the bottom end 121 of the liner 120. Such an expanding device expands the liner 120 when it is retrieved from the wellbore 110. Expanding the liner places or deploys the liner 120 in the wellbore 110.

In one aspect, the liner 120 may include one or more features (generally denoted by numeral 162) that are desired to be oriented in a particular direction when the liner is deployed or placed in the wellbore 110. A suitable sensor 170 associated with the drilling assembly 118 and the liner 120 is used to estimate or determine the location of the feature 162 relative to the location of a known marker or element in the drilling assembly 120 or the drill string. The sensor 170 provides signals representative of the movement or displacement of the liner feature from a known location on the drilling assembly or the drill string 118. One or more inclination and orientation sensors 172 (such as accelerometers, magnetometers and gamma ray devices) carried by the drilling assembly 130 provide inclination and orientation of the drilling assembly 130. A controller 190 at the surface and/or a controller 185 carried by the drilling assembly 118 determines the orientation of the drilling assembly 118 from the orientation sensor 172 measurements and that of the liner feature 162 from the liner orientation sensor 170 measurements. The controller 185 may include a processor 186, such as a microprocessor, a data storage device 187 for storing therein data and programs 188. Similarly, the surface controller 190 may be a computer-based system that includes a processor 192, a data storage device 194 for storing data and programs 196. The data storage devices 187 and 194 may be any suitable device, including, but not limited to, a read-only memory (ROM), a random-access memory (RAM), a flash memory and a disk.

Figure 2:
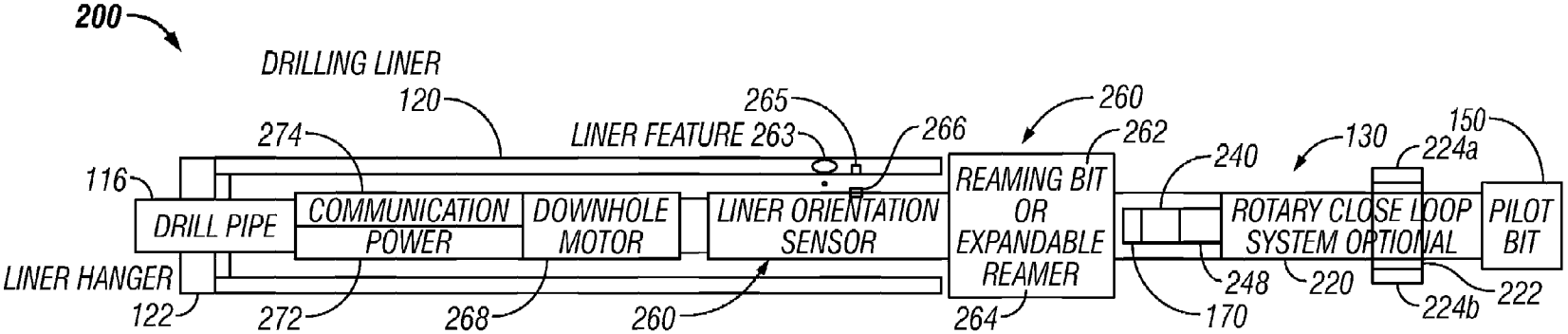
FIG. 2 shows a schematic diagram of an exemplary drilling assembly with a liner placed outside a portion of the drilling assembly and a sensor that may be utilized for estimating the orientation of a feature of the liner.

FIG. 2 shows a schematic diagram of an exemplary system 200 containing a drilling assembly 130 with a liner 120 placed around a portion of the drilling assembly. A sensor arrangement or device 260 (also referred to herein as the "liner orientation sensor" or "sensor") associated with the drilling assembly 130 and the liner 120 may be utilized for estimating the orientation of a feature 263 in the liner 120 when the liner is in the wellbore 110. The drilling assembly 130 may further include a steering device or mechanism 220 above the pilot drill bit 150. In one aspect, the steering device 220 may be a closed-loop device or system, which contains a plurality (generally three or more) of independently-controlled force application members, such as members 224*a*, 224*b*, etc. Each force application member is configured to apply a desired amount of force on the wellbore wall to steer the pilot bit 150 in a desired direction. The force vector produced by the combination of the forces exerted by the plurality of force application members 242*a*, 242*b*, etc. defines the drilling direction. The steering device 220 may include a power unit 272 that supplies power to each of the force application members to independently move each such force application member radially toward the wellbore wall. The power unit 272 may be any suitable device, including, but not limited to, a device wherein a pump supplies fluid under pressure to a piston that moves an associated force application member radially outward or an electric motor that drives a linear member, which in turn moves an associated force application member radially outward. When the drill string 118 is rotated, the pilot bit 150 rotates and drills the lower portion having a first diameter of the wellbore 110, while the reaming drill bit 262 enlarges the wellbore 110 drilled by the pilot drill bit 150 to a second larger diameter.

Still referring to FIG. 2, in one aspect, a drilling motor (also referred to as a mud motor or a downhole motor) 268 may be provided in the drilling assembly 130 to rotate the pilot drill bit 150. The mud motor, in one aspect, superimposes the rotation of drill string 118. The force application members 242*a*, 242*b*, etc. may be activated during the drilling of the wellbore 110 to drill the wellbore along a desired path or trajectory.

Still referring to FIG. 2, the drilling assembly 130 may also include any number of measurement-while-drilling (MWD) sensors or devices, which are collectively designated herein by numeral 240. The MWD sensors (or devices) 240 may include any sensor that is useful for obtaining information about the formation 119 surrounding the wellbore 110. The MWD sensors 240 may include resistivity sensors, acoustic sensors, nuclear sensors, nuclear magnetic resonance sensors, formation testing sensors and any other desired sensors. The drilling assembly 130 also may contain one or more position sensors (generally designated herein by numeral 248). The position sensors 248 may be configured to periodically or continuously provide measurements relating to the inclination and orientation of the drilling assembly 130 in the wellbore. Any suitable sensor may be used for providing measurements relating to the inclination and orientation of the drilling assembly 130, including, but not limited to, accelerometers, magnetometers, and gamma ray devices. The position sensors 248 may provide sufficient measurements to a control unit 170 (see FIG. 1) carried by the drilling assembly 130, which control unit may calculate or estimate the inclination and orientation of the drilling assembly 130 during drilling of the wellbore 110. The processor 172 of the control unit 170 accesses the data, computer programs and models and estimates the inclination and orientation of the drilling assembly 130 in the wellbore. The processor 172 may use the measurements made by the sensors 248 and programmed instruction stored in the storage device 174 to calculate the inclination, orientation and position of the drilling assembly 130 in the wellbore. Alternatively, signals from the position sensors 248 may be transmitted to the surface controller 190 for calculating the inclination, orientation and position of the drilling assembly 130. Further, a combination of the downhole controller 170 and the surface controller 190 may be used to estimate the drill string inclination, orientation and/or position of the drilling assembly.

Still referring to FIG. 2, the drilling assembly 130 may further include a power unit 272 and a data communication device 274. The power unit 272 generates power downhole for use by the various sensors and devices associated with the drilling assembly 130. Any suitable device may be used to generate power downhole, including, but not limited to, a device that utilizes a turbine driven by the circulating drilling fluid in the wellbore 110. The communication unit 274 provides two-way data communication between the surface devices, such as the controller 190, and downhole devices, such as the controller 170 and the MWD device 240. Any suitable telemetry system may be utilized for establishing the two-way communication between the downhole devices and the surface, including but not limited to, a mud pulse telemetry, an acoustic telemetry, an electromagnetic telemetry or a wired-pipe telemetry. Wired-pipe may include communication links, such as electrical conductor or optical fibers that run in or along the drilling string 118. The telemetry system 274 may also include communication devices that transmit signals across the joints jointed tubulars, including, but not limited to, electrical, electromagnetic and acoustic devices.

Still referring to FIG. 2, the drilling liner 120 is shown to include a feature 262, such as a window, that will be used for drilling a lateral wellbore from the wellbore 110 or perforations to allow the flow of the fluid from the formation 119 into the wellbore 110 or any other desired feature. Often, such features are formed in the liner at the surface so as to avoid performing cutting operations after the liner has been placed in the wellbore. For example, it may be desirable to form a window in the liner at the surface to avoid cutting of the window in the liner in the wellbore or to perforate the liner so as to avoid perforating the liner after installation in the wellbore 110.

The system 200 further may include a liner orientation sensor (or sensor) 260. The sensor 260 is shown to include a sensed element (or first element) 265 associated with or carried by the liner 120 and a sensing element (or second element) 266 carried by the drilling assembly 130. In one aspect, the liner orientation sensor 260 may be placed proximate the feature, such as feature 263 shown in FIG. 2. Any suitable sensor arrangement may be utilized to determine the orientation or relative location of the feature 263 with respect to a location of a known element on the drilling assembly 130, such as the location of the sensing element 266 or another marker associated with the drilling assembly 130 or the drill string 118. In one configuration, the liner orientation sensor 260 may include a coil carried by the drilling assembly 130 as the sensing element 266 configured to sense a magnetic field from a magnet (the sensed element 265) placed on the liner 120. In another aspect, the liner orientation sensor 260 may comprise a coded magnetic field as the sensed element 265 on the liner 120 and a coil or detector as the sensing element 266 that senses changes in the coded magnetic field due to changes in the orientation or displacement of the liner 120. Electrical sensors, acoustic sensors, photoacoustic sensors, etc. also may be utilized for determining the liner orientation. The term movement herein comprises the term displacement.

In operation, the liner orientation sensor 260 provides signals representative of the movement or displacement of the feature 263. The position sensors 248 provide signals relating to the orientation of the drilling assembly 130. In one aspect, the controller 170 may be configured to process signals from the liner orientation sensor 260 and the position sensors 248 to estimate the orientation of the liner and correlate the determined liner orientation with the orientation of the drilling assembly 130. Alternatively, signals or processed signals from the liner orientation sensor 260 and/or the position sensors 248 may be sent to the surface controller 190 for estimating the orientation of the feature 263. Also, both the surface controller 190 and the downhole controller 170 may cooperate to determine the feature orientation. The determined feature orientation may be displayed for use by an operator. The operator may rotate the liner 130 from the surface to align the feature 263 along the desired orientation before setting the liner 130 in the wellbore 110. The terms estimate and determine are used as synonyms.

Figure 3:
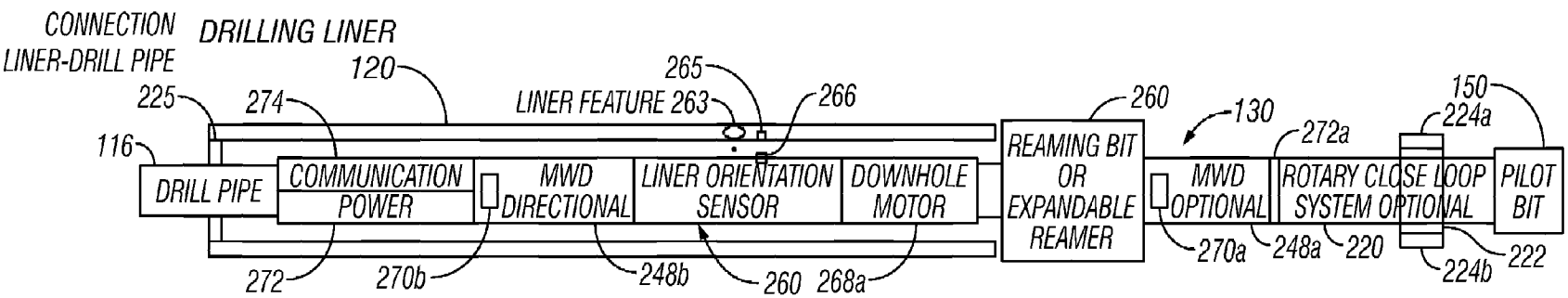
FIG. 3 shows a schematic diagram of another exemplary drilling assembly with a liner placed around a portion of the drilling assembly and a sensor that may be used for estimating the orientation of a feature of the liner.

FIG. 3 shows a schematic diagram of another exemplary drilling assembly 130 with a liner 120 placed around a portion of the drilling assembly 130 and a sensor arrangement 260 that may be used for estimating the orientation of a feature 263 on the liner 120 during drilling of the wellbore 110. This configuration is similar to that shown in FIG. 2, but in this configuration: (i) the drilling motor **268*a* is shown placed below or downhole of the liner orientation sensor 260, (ii) some of the MWD sensors 248*a* are shown placed below the reamer bit 262 and the remaining MWD sensors 248*b* are shown placed above the reamer bit 262; and (iii) and the controller 270*b* are shown placed uphole of the reamer bit 262. The operations and functions relating to the liner orientation sensor 260 and other devices are the same as described above with respect to FIG. 2**.

Thus, in one aspect, an apparatus for use in a wellbore is disclosed that includes: a drilling assembly configured for use in drilling the wellbore; a liner disposed outside a portion of the drilling assembly that includes a feature at a selected location of the liner; and a liner orientation sensor associated with the liner and the drilling assembly for providing signals representative of the movement of the feature relative to the drilling assembly. The liner orientation sensor may further include a sensed element carried by the liner and a sensing element carried by the drilling assembly, wherein the sensing element generates the signals representative of the movement of the feature with respect to the drilling assembly. In another aspect, the liner orientation sensor may include a magnetic element at a selected location on the liner and a coil proximate the magnetic element on the drilling assembly for providing signals corresponding to a change in the magnetic field generated by the magnetic element. The magnetic element may be: (i) a permanent magnet or (ii) a coded magnetic field on a surface of the liner. The sensing element may be carried by a substantially non-rotating member of the drilling assembly or a rotating member of the drilling assembly.

In another aspect, the drilling assembly may further include a drilling assembly orientation sensor for determining the orientation of the drilling assembly in the wellbore. In another aspect, the apparatus may further include a processor that determines the orientation of the feature by utilizing information provided by the liner orientation sensor and the drilling assembly orientation sensor. In another aspect, the apparatus may further include a first drill bit at a bottom end of the drilling assembly for drilling the wellbore of a first diameter and a second drill bit uphole of the first drill for reaming the wellbore of the first diameter to a second larger diameter. In another aspect, the apparatus may include a steering device that contains a plurality of independently-adjustable force application members that are configured to apply force on the wellbore to drill the wellbore along a desired direction. The drilling assembly may rotate relative to the liner or may be non-rotating.

In another aspect, a method for estimating orientation of a liner placed outside a drill string during drilling of a wellbore may include: conveying the drill string in the wellbore; providing a liner outside the drilling assembly, the liner having a feature thereon at a selected location of the liner; providing a sensor on the drill string and the liner; taking a measurement by the sensor in the wellbore that is representative of a movement or displacement of the feature on the liner that occurs in the wellbore; processing the measurement to estimate an orientation of the feature in the wellbore. In another aspect, the method may include estimating an orientation of the drilling assembly using the estimated orientation of the drilling assembly and the measurement made by the sensor to estimate the orientation of the feature.

The foregoing description is directed to particular embodiments for the purpose of illustration and explanation. It will be apparent, however, to one skilled in the art that many modifications and changes to the embodiments set forth above are possible without departing from the scope and the spirit of the disclosure. It is intended that any claims relating to this application and any application that takes priority from this application be interpreted to embrace all such modifications and changes. The Summary is provided herein only to aid the reader in understanding certain aspects of the disclosure. The Abstract is provided to satisfy certain regulatory requirements. The embodiments disclosed herein, Summary and Abstract provided herein are not to be used to limit the scope of any claims made in this application or any application that takes priority from this application.

What is claimed is:

1. An apparatus for use in a wellbore, comprising:

a drilling assembly configured for use in drilling the wellbore;

a liner disposed outside a portion of the drilling assembly, the liner including a feature at a selected location on the liner; and a liner orientation sensor configured to provide signals representative of a movement of the feature relative to the drilling assembly.

2. The apparatus of claim 1, wherein the liner orientation sensor includes a sensed element associated with one of the liner and the drilling assembly and a sensing element associated with the other of the liner and the drilling assembly, wherein the sensing element is configured to provide the signals representative of the movement of the feature relative to the drilling assembly.

3. The apparatus of claim 2, wherein the sensed element is a magnetic element proximate the selected location on the liner and the sensing element is a coil on the drilling assembly, wherein the signals provided by the sensing element correspond to a change in the magnetic field due to the movement of the feature relative to the drilling assembly.

4. The apparatus of claim 3, wherein the magnetic element is one of a permanent magnet and coded magnetic field.

5. The apparatus of claim 2, wherein the sensing element is placed on one of a substantially non-rotating sleeve of the drilling assembly and a rotating member of the drilling assembly.

6. The apparatus of claim 1 further comprising a drilling assembly orientation sensor configured to determine an orientation of the drilling assembly in the wellbore.

7. The apparatus of claim 6 further comprising a processor configured to estimate an orientation of the feature by utilizing signals provided by the liner orientation sensor and the drilling assembly orientation sensor.

8. The apparatus of claim 1 further comprising a first drill bit at a bottom end of the drilling assembly configured to drill the wellbore to a first diameter and a second drill bit uphole of the first drill bit configured to ream the wellbore from the first diameter to a second diameter.

9. The apparatus of claim 8 further comprising a steering device in the drilling assembly having a plurality of independently-adjustable force application members that are configured to apply a force on the wellbore to drill the wellbore along a desired direction.

10. The apparatus of claim 1 wherein the drilling assembly is configured as one of: to rotate relative to the liner and to substantially not rotate relative to the liner.

11. The apparatus of claim 1 further comprising a conveying member attached to the drilling assembly for conveying the drilling assembly into the wellbore.

12. A method of performing an operation in a wellbore, comprising:

providing a drilling assembly configured for use in drilling the wellbore;

attaching a liner to an outside portion of the drilling assembly, the liner including a feature at a selected location of the liner;

conveying the drilling assembly with the liner into the wellbore; and estimating movement of the feature relative to the drilling assembly using a sensor associated with the drilling assembly.

13. The method of claim 12, wherein the sensor includes a sensed element associated with one of the liner and the drilling assembly and a sensing element associated with the other of the liner and the drilling assembly, wherein the sensing element provides signals representative of the movement of the feature relative to the drilling assembly.

14. The method of claim 13, wherein the signals provided by the sensor correspond to a change in a magnetic field due to the movement of the feature relative to the drilling assembly.

15. The method of 13, wherein the sensed element is one of a permanent magnet and coded magnetic field.

16. The method of claim 12 further comprising estimating an orientation of the drilling assembly in the wellbore.

17. The method of claim 16 further comprising estimating an orientation of the liner in the wellbore using the estimated movement of the feature and the estimated orientation of the drilling assembly in the wellbore.

18. The method of claim 12, wherein drilling the wellbore comprises drilling a wellbore to a first diameter using a first drill bit and enlarging the first diameter wellbore to a second diameter using a second drill bit disposed uphole of the first drill bit.

19. The method of claim 17 further comprising rotating the liner in the wellbore based at least in part on the estimated orientation of the liner in the wellbore.

20. The method of claim 16 further comprising drilling the wellbore with the drilling assembly and the liner to a selected depth, estimating an orientation of the liner relative to the drilling assembly and orienting the liner in the wellbore based on the estimated orientation of the liner relative to the drilling assembly.

* * * * *